United States Patent [19]

Gruen

[11] Patent Number: 4,505,415

[45] Date of Patent: Mar. 19, 1985

[54] WIRE LOOP STITCHING MACHINE HEAD

[75] Inventor: Alfred J. Gruen, Chicago, Ill.

[73] Assignee: Interlake, Inc., Oak Brook, Ill.

[21] Appl. No.: 420,046

[22] Filed: Sep. 20, 1982

[51] Int. Cl.[3] ..... B27F 7/23

[52] U.S. Cl. ..... 227/88; 227/82

[58] Field of Search ..... 227/82, 88, 89, 90

[56] References Cited

U.S. PATENT DOCUMENTS

| | | | |
|---|---|---|---|
| 970,461 | 9/1910 | Briggs | 227/88 |
| 1,252,011 | 1/1918 | Maynard | 227/88 |
| 1,357,319 | 11/1920 | Hadaway | 85/49 |
| 1,491,272 | 4/1924 | Perkins | 227/88 |
| 1,491,273 | 4/1924 | Perkins | 227/88 |
| 1,530,362 | 3/1925 | Harmon | 227/88 |
| 2,138,495 | 11/1938 | Lewis | 227/88 |
| 2,741,147 | 4/1956 | Marano | 85/49 |

OTHER PUBLICATIONS

"Interlake Instruction Manual for Single & Multiple Head Champion Stitchers" Interlake Corporation 1980 form 1132-R5-80.

*Primary Examiner*—Paul A. Bell

*Attorney, Agent, or Firm*—Emrich & Dithmar

[57] ABSTRACT

A wire loop stitching machine includes a reciprocating drive coupled to a staple-forming and drive means and to a wire feed means for feeding a length of staple wire to a holder and severing it. A bender forms the wire over the holder into a generally inverted U-shaped staple. A supporter with a rounded projection is then inserted between the legs of the staple and a recessed driver deforms the bight portion of the staple over the projection into a curved loop portion and then drives the formed loop staple into an associated workpiece, retracting the supporter in the process.

9 Claims, 16 Drawing Figures

WIRE LOOP STITCHING MACHINE HEAD

BACKGROUND OF THE INVENTION

The present invention relates to a wire stitching or stapling machine of the type which severs and forms staples from a continuous wire and drives the staples into an associated workpiece. In particular, the invention relates to a stitching head for such a machine.

The present invention is an improvement of the wire stitching machine sold by Interlake, Inc., the assignee of the present invention, under the trademark "CHAMPION STITCHER". This prior stitching machine, which is in turn an improvement of the machine described in U.S. Pat. No. 1,252,011, includes a stitching head having a wire feed mechanism for feeding a predetermined length of wire from a continuous wire supply to a wire holder, where the length of wire is severed from the supply, and a staple-forming and driving mechanism which forms the severed length of wire into a staple and drives it into an associated workpiece. The mechanism undergoes a cyclical reciprocating movement comprising a drive stroke and a return stroke. During each drive stroke the feed means is feeding a predetermined length of wire to the wire holder, while the staple-forming and driving means is forming and driving the length of wire which had been fed during the preceding drive stroke. Both mechanisms then retract simultaneously, and at the end of each cycle there is left in the wire holder a severed length of wire ready to be formed and driven during the next drive stroke.

This type of stitching head operates to form a standard staple which is substantially in the shape of an inverted U, having a pair of parallel leg portions interconnected by a straight bight portion disposed substantially perpendicular to the leg portions. When the staple is driven through the associated workpiece the legs are folded over by a clincher to complete the stapling or stitching operation. In its clinched condition the staple has both its bight portion and its leg portions disposed flat against the associated workpiece.

However, for certain applications it is desirable to provide a staple wherein the bight portion or a part thereof forms a "loop" which is spaced from the associated workpiece. This type of staple is useful in certain applications, such as in the preparation of a loose leaf binder. Thus, pages of the binder can be stapled together and folded, so that the loop portions of the staples can be inserted over the rings or posts of a loose leaf binder. However, such "loop"-type staples cannot be formed on the stitching machine of the type disclosed in the aforementioned U.S. Pat. No. 1,252,011, or in the Interlake "CHAMPION STITCHER".

Such "loop"-type staples and machines for forming them are known, but such machines are of a completely different construction from that of the Interlake "CHAMPION STITCHER". Furthermore, all such machines operate by first forming the "loop" portion of the staple then forming the legs thereof.

SUMMARY OF THE INVENTION

It is the general object of the present invention to provide an improved stitching machine which avoids the disadvantages of prior stitching machines while affording additional structural and operating advantages.

An important object of this invention is the provision of a wire loop stitching machine which operates to form the legs of the staple prior to the formation of the "loop" portion.

In connection with the foregoing object, it is another object of this invention to provide a method for forming a wire loop staple in the sequence set forth.

Yet another object of this invention is the provision of a modified form of the wire stitching machine disclosed in the aforementioned U.S. Pat. No. 1,252,011 which is capable of forming "loop"-type staples and driving same.

More particularly, in connection with the foregoing object it is an object of this invention to provide a modified stitching machine of the type set forth, which entails only minor modifications in the standard stitching head with no modifications to any other part of the stitching machine.

These and other objects of the machine are obtained by providing a wire loop stitching machine for forming a length of staple wire held in a forming region, said stitching machine comprising first forming means engageable with the length of staple wire for forming it into a generally inverted U-shaped staple having a pair of substantially straight parallel leg portions interconnected by a substantially straight bight portion disposed substantially perpendicular to the leg portions, and second forming means cooperating with the first forming means for engagement with the bight portion of the staple to deform the bight portion into a curved loop portion which is concave as viewed from the distal ends of the leg portions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2:
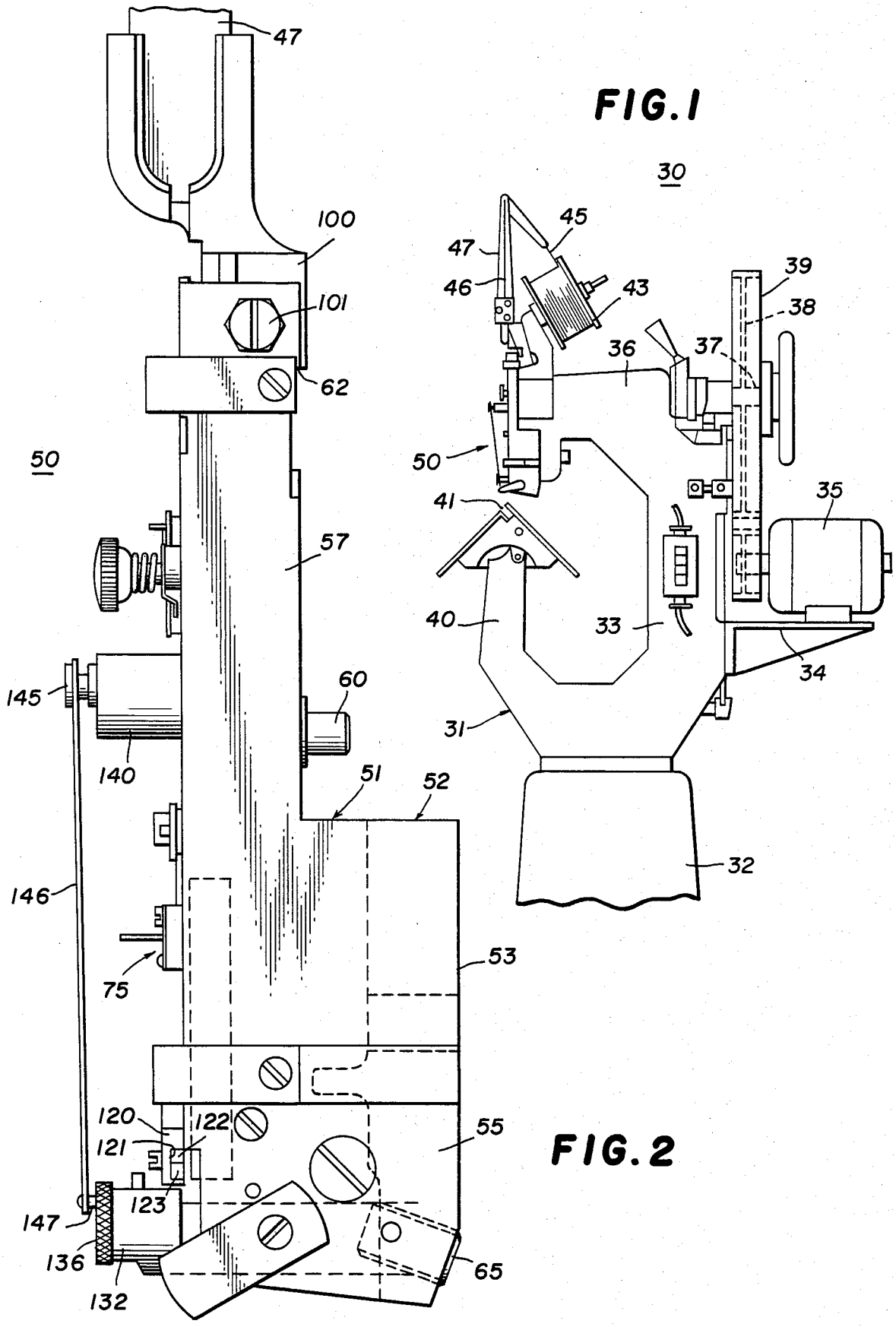
FIG. 1 is a fragmentary, side elevational view of a stitching machine incorporating a stitching head constructed in accordance with and embodying the features of the present invention.
FIG. 2 is an enlarged, side elevational view of the stitching head of FIG. 1.

Referring to FIG. 1 of the drawings, there is illustrated a wire stitching machine, generally designated by the numeral 30, which is of the type disclosed in the aforementioned '011 patent, and includes a stitching head 50 constructed in accordance with and embodying the features of the present invention. The stitching machine 30 is includes a frame 31 supported on a suitable pedestal 32 and including an upstanding support post 33. Fixedly secured to the rear end of the support post 33 is a platform 34 supporting thereon an electric drive motor 35. Integral with the support post 33 at the upper end thereof and projecting forwardly therefrom is a generally horizontal support arm 36 which houses a drive shaft 37, the rear end of which is connected to a flywheel 38, which is coupled by a drive belt 39 to the output shaft of the drive motor 35. At the forward end of the drive shaft 37 is linkage (not shown) for converting the rotary motion of the shaft to a vertically reciprocating motion, which is then transmitted to the stitching head 50 which is fixedly secured to the front end of the support arm 36.

Figure 12:
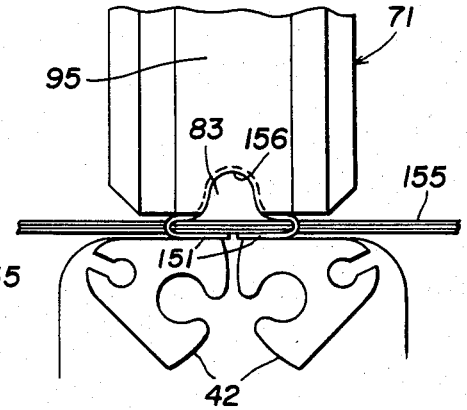
FIG. 12 is a view, similar to FIG. 9, illustrating the parts in the position of FIG. 11, and showing the completely formed and clinched staple.

The frame 31 also includes an upstanding clincher post 40 disposed forwardly of the support post 33 and provided at the upper end thereof with a clincher assembly 41 including clincher jaws 42 (see FIG. 12) spaced a predetermined short distance below the bottom of the stitching head 50. Carried by the support arm 36 adjacent to the front end thereof is a supply roll 43 of stitching wire 45 being fed along a wire guide 47 to the stitching head 50 in a manner which will be explained more fully below. The machine 30 may be provided with suitable control means for controlling the operation thereof. While a single-head stitching machine 30 is illustrated in FIG. 1, it will be appreciated that the machine 30 could be provided with multiple stitching heads 50 operated in tandem.

The stitching head 50 is very similar in construction to the stitching head disclosed in the aforementioned U.S. Pat. No. 1,252,011, and that used in the Interlake "CHAMPION STITCHER". Accordingly, only so much of the stitching head 50 as is necessary to an understanding of the operation of the present invention will be described herein in detail, and the aforementioned patent may be referred to for a more specific explanation of the construction and operation of the remainder of the stitching head 50.

Figure 3:
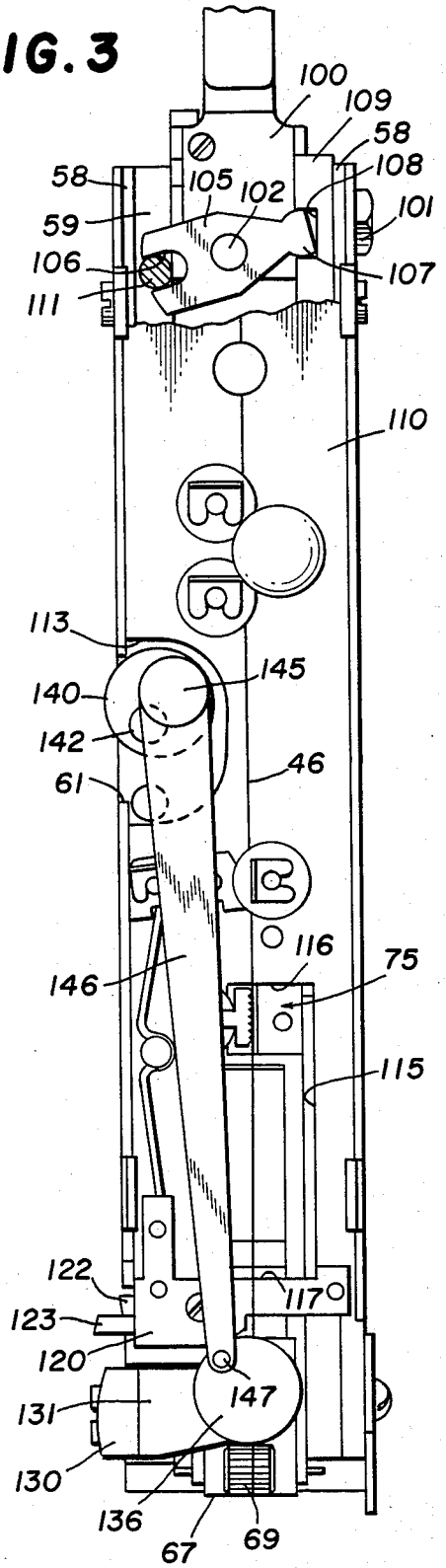
FIG. 3 is a front elevational view of the stitching head of FIG. 2, with a portion broken away more clearly to show the construction.

Referring now to FIGS. 2 through 5 of the drawings, the stitching head 50 includes a metal frame, generally designated by the numeral 51, which is preferably in the form of a single-piece casting. The frame 51 includes a channel-shaped base portion 52 including a rear wall 53 and two forwardly-extending side walls 54 and 55, respectively provided with elongated upstanding extension portions 56 and 57 which are disposed forwardly of the rear wall 53 and cooperate to define a slot therebetween. The forward edges of the side walls 54 and 55 are recessed along the entire lengths thereof to define first relatively shallow shoulders 58 and second deeper shoulders 59. Extending the length of the side walls 54 and 55 a slight distance rearwardly of the level of the second shoulders 59 are elongated rectangular grooves (not shown). The front edges of the side walls 54 and 55 are cut away at the lower ends thereof to the levels of the second shoulders 59. The side wall 54 is also cut away, as at 61, intermediate the ends thereof to the level of the second shoulders 59. The rear surfaces of the side wall extension portions 56 and 57 are recessed adjacent to the upper ends thereof, as at 62 (FIG. 2). The base portion 52 of the frame 51 is provided with an internally threaded bore 63 (FIG. 4) extending through the rear wall 53 and inclined slightly upwardly and forwardly for receiving therein a hollow bushing plug 65 in which is seated a helical compression spring 66. The spring 66 bears against the rear surface of a lever 67 which is disposed between the side walls 54 and 55 for pivotal movement about the axis of a pivot pin 68. The lower end of the lever 67 is clevis-shaped and carries between the legs thereof a rotatable roller 69 (FIG. 3).

Disposed between the side walls 54 and 55 is an elongated channel-shaped drive slide assembly (not shown) adapted for sliding movement longitudinally of the frame 51. The drive block has a rearwardly projecting lug 60 (FIG. 1) which is coupled to the drive linkage of the stitching machine 30 for transmitting the reciprocating movement of the drive linkage to the drive slide assembly.

Figure 6:
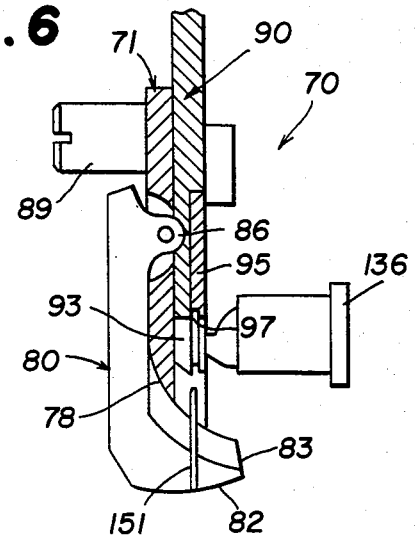
FIG. 6 is a fragmentary view, similar to FIG. 4, of the staple forming portion of the stitching head, illustrated with the staple support lever disposed in its supporting position after formation of the inverted U-shaped staple.
Figure 7:
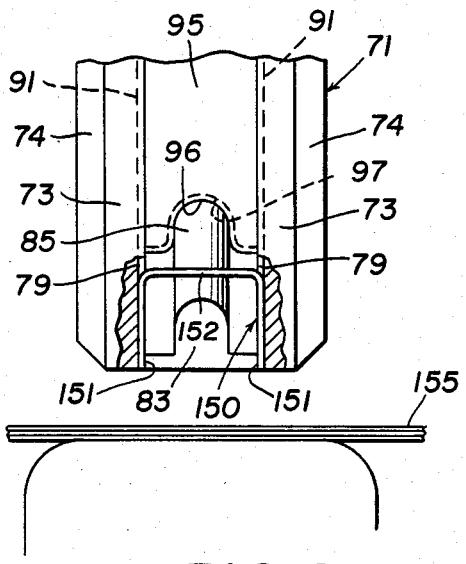
FIG. 7 is an enlarged, fragmentary, front elevational view of the staple forming apparatus of FIG. 6.

Referring now also to FIGS. 6 and 7, there is coupled to the drive slide assembly is a staple-forming and driving assembly 70, which includes a bender bar 71, a support lever 80 and a drive bar 90. The bender bar 71 is a generally channel-shaped member having a rectangular rear wall 72 and a pair of forwardly extending side walls 73. The bender bar 71 is disposed in the channel between the side walls 54 and 55 of the frame 51 and below the drive slide assembly, the side walls 73 being spaced inwardly from the lateral edges of the rear wall 72 so that those edges respectively define guide rails 74 which are slidably received in grooves (not shown) in the side walls 54 and 55 for guiding vertical sliding movement of the bender bar 71 in the frame 51.

Spanning the side walls 73 of the bender bar 71 and fixedly secured thereto by suitable means is a wire gripping assembly, generally designated by the numeral 75, the construction and operation of which is fully described in the aforementioned '011 patent. The wire gripping assembly 75 operates to grip the supply portion 46 of the stitching wire 45 and to feed a predetermined length thereof for severing, formation into a staple and driving of the staple through an associated workpiece during each cycle of operation of the wire stitching machine 30.

The side walls 73 of the bender bar 71 extend downwardly below the lower end of the rear wall 72 to form a pair of depending legs, the bottom edge of the rear wall 72 being inclined slightly upwardly and rearwardly, as at 77 (see FIG. 4). Additionally, the rear surface of the rear wall 72 has an arcuate recess 78 formed therein centrally thereof, the recess 78 tapering upwardly and rearwardly so that at the upper edge thereof it has zero depth while at the lower edge thereof it extends completely through the rear wall 72. Also, formed in the inner sides of the side wall 73 and extending the length thereof are elongated wire grooves 79, for a purpose to be explained more fully below (see also FIG. 7).

Disposed behind the bender bar 71 and pivotally coupled thereto is a support lever, generally designated by the numeral 80, which has a rectangular body 81 provided at the lower end thereof with forwardly extending foot 82 terminating in a flat end wall 83. The support lever 80 has an elongated curved projection 85 thereon extending along the length of the foot 82 centrally thereof and upwardly a slight distance along the body 81, the projection 85 being substantially partcircular in transverse cross section. The upper end of the body 81 is provided with a forwardly extending attachment flange 86 (see FIGS. 4 and 6) which is received in a complementary recess in the rear of the bender bar rear wall 72 and is pivotally coupled thereto by a pivot pin 87. The portions of the side walls 73 of the bender bar 71 which extend downwardly below the lower end of the rear wall 72 accommodate therebetween the foot 82 of the support lever 80. The support lever 80 is provided with a laterally extending cam pin 88 (see FIG. 4) which is disposed for camming engagement with a guide plate (not shown) fixedly secured to the inner surface of the frame side wall 55.

The rear wall 72 of the bender bar 71 has a circular bore therethrough adjacent to the upper end thereof for threadedly receiving therein a hollow bushing 89 in which is seated a helical compression spring (not shown) which bears against a friction pad for resiliently urging into frictional engagement with the rear surface of an elongated rectangular drive bar 90 which is disposed in the channel between the side walls 73 of the bender bar 71. The drive bar 90 is provided along the side edges thereof with laterally outwardly extending guide flanges 91 (see FIG. 7) respectively slidably received in the grooves 79 in the inner surfaces of the bender bar side walls 72. The drive bar 90 extends upwardly well beyond the upper end of the bender bar 71 and is coupled at to the upper end thereof to of the drive slide assembly. The front surface of the drive bar 90 is provided with a recess 92 at the lower end thereof for receiving therein a flat drive member 95. The drive bar 90 and the drive member 95 are respectively provided with substantially congruent arcuate recesses 93 and 96 in the lower ends thereof centrally thereof, the recesses 93 and 96 being shaped complementary to the projection 85 on the support lever 80. Additionally, the drive member 95 is provided in the rear surface thereof with a shallow groove 97 (FIG. 6) which extends across the lower edge of the drive member 95 and follows the recess 96.

Disposed between the frame side wall extension portions 56 and 57 at the upper ends thereof is a wire guide bracket 100 which is provided with laterally outwardly extending guide ribs (not shown) keyed into grooves in the frame 51. The bracket 100 is fixedly secured to the frame 51 by a mounting screw 101 and carries thereon the wire guide 47 illustrated in FIG. 1. The wire guide bracket 100 carries a forwardly projecting pivot stud 102 (see FIG. 3) which is received in a complementary bore in a grip release lever 105 for pivotally mounting same. The lever 105 has a generally U-shaped slot 106 at one end thereof and is provided at the other end thereof with a projection 107 disposable in a rectangular recess 108 formed at one end of an elongated grip release slide bar 109 which rests on the adjacent shoulder 59 of the frame 51. The slide bar 109 is also provided with an elongated recess adjacent to the lower end thereof (not shown) which defines at the upper and lower edges thereof inclined cam surfaces respectively. It will be appreciated that as the lever 105 is rotated the slide bar 109 is slid vertically longitudinally of the frame 51 for adjusting the length of wire fed during each cycle, as explained in the aforementioned '011 patent.

The mechanism heretofore described is covered by a face plate 110 (see FIG. 3) which is rectangular and dimensioned to rest upon the shoulders 58 of the frame 51. Fixedly secured to the face plate 110 and projecting rearwardly therefrom is a pin 111 which is disposed in the slot 106 of the lever 105 for rotation thereof as the face plate 110 is adjusted up or down. The face plate 110 has a large, generally rectangular recess 113 formed in the lefthand side thereof, as viewed in FIG. 3, generally adjacent to the cutout portion 61 in the frame side wall extension portion 56. Formed in the face plate 110 adjacent to the lower end thereof is a large rectangular aperture or window 115 defining at the upper and lower ends thereof stop surfaces 116 and 117 respectively. The wire gripping assembly 75 extends forwardly through the window 115 in the face plate 110.

Fixedly secured to the face plate 110 at the lower end thereof is a cutter housing 120 having a channel 121 formed in the rear surface thereof (see FIG. 2) for accommodating therein a fixed cutter 122 and a movable cutter 123. The fixed cutter 122 has a key (not shown) on the front surface thereof which is received in a slot in a stud in the cutter housing 120 to hold the cutter 122 in place. The movable cutter 123 has a key (not shown) on the rear surface thereof which is disposed in an elongated cam groove formed in the front surface of a cutter operating slide (not shown) which is slidably disposed on the shoulder 59 of the frame side wall 54. As the cutter operating slide moves upwardly and downwardly in response to corresponding movements of the drive slide assembly, it effects a cammed lateral movement of the movable cutter 122 which cooperates with the fixed cutter 123 to sever the wire 45 in a well-known manner.

Figure 4:
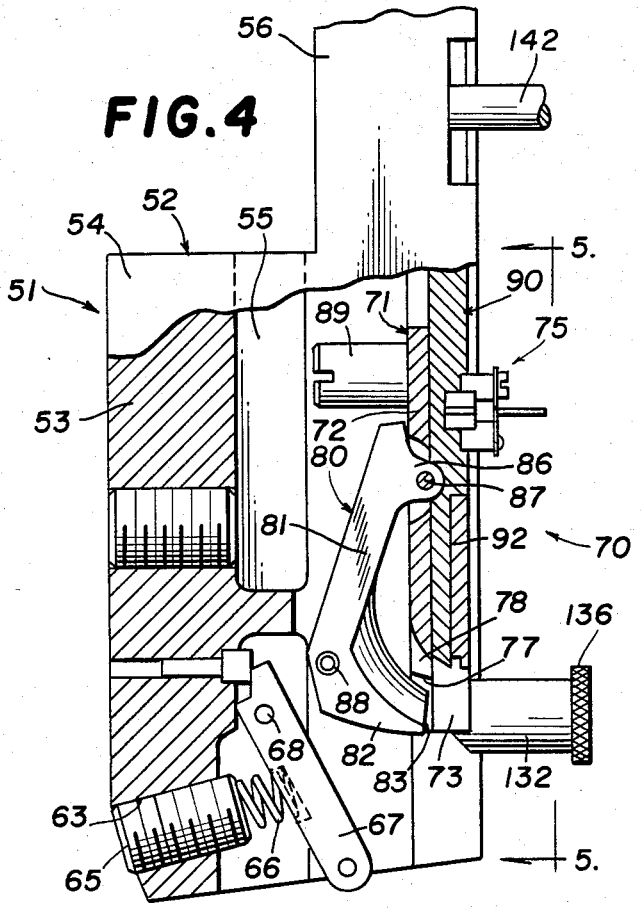
FIG. 4 is a fragmentary, side elevational view in partial vertical section of the lower portion of the stitching head of FIG. 3, as viewed from the left hand side thereof, with the parts illustrated in the intial portion of the drive stroke.
Figure 9:
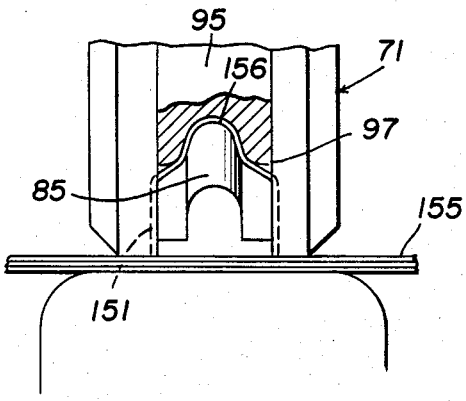
FIG. 9 is a view, similar to FIGS. 7 and 8, illustrating the parts with the "loop" portion of the staple partially formed.
Figure 10:
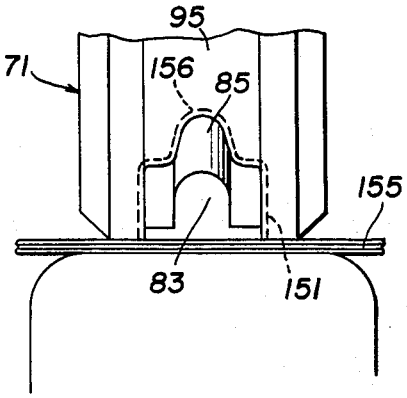
FIG. 10 is a view, similar to FIG. 9, illustrating the parts with the "loop" portion of the staple completely formed.
Figure 11:
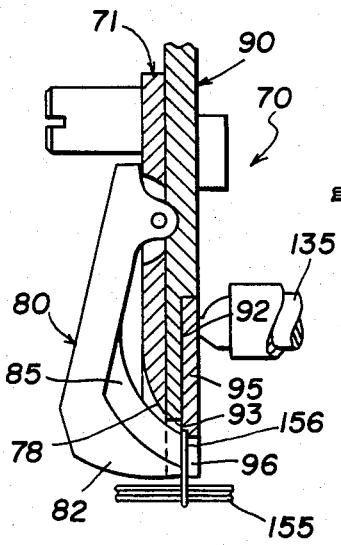
FIG. 11 is a view, similar to FIG. 6, illustrating the parts after the staple has been driven through the associated workpiece with the support lever retracted.

Fixedly secured to the frame side wall 54 is a bracket 130 (see FIG. 3) which is provided at the front end thereof with an arm 131 which extends laterally across the front of the frame 51 and has formed at the distal end thereof a cylindrical sleeve 132 (see FIGS. 2 and 4). The front edge of the sleeve 132 is shaped to form a cam surface and a stop surface (not shown). Rotatably disposed in the sleeve 132 coaxially therewith is a cylindrical wire holder 135 (FIG. 5) which has an enlarged part-circular head 136 which limits the depth of insertion of the wire holder 135. Extending radially outwardly from the wire holder 135 is a cam pin (not shown) disposed for camming engagement with the cam surface on the sleeve 132, so that as the wire holder 135 rotates it is moved axially inwardly and outwardly by cam action. The wire holder 135 is similar in construction and operation to that disclosed in FIG. 9 of the '011 patent.

Rotation of the wire holder 135 is effected by a cylindrical operating cam 140 which has an eccentric bore extending therethrough for receiving therein a mounting pin 142 which is fixedly secured to the shoulder 59 of the frame side wall 54 centrally of the cutout 61. The rear end of the operating cam 140 is formed as explained in the '011 patent to define a slot for receiving therein a pin carried by the drive slide. In operation, as the drive slide assembly moves upwardly and downwardly, the pin moves into the slot to effect rotation of the cam 140. The cam 140 has a second bore extending therethrough for receiving therein a pin 145. The outer end of the pin 145 is fixedly secured to one end of an elongated operating spring arm 146, the other end of which is provided with a pin 147 receivable in a complementary recess in the head 136 of the wire holder 135. Thus, it will be appreciated that, through the arm 146, rotation of the cam 140 effects an opposite direction rotation of the wire holder 135, the spring action of the arm 146 also serving resiliently to urge the wire holder 135 axially into the sleeve 132.

In operation, initially, the supply portion 46 of the wire 45 is fed from the supply roll 43 along the wire guide 47 and then downwardly across the front of the stitching head 50, the leading end of the wire 45 being fed through the wire gripping assembly 75 and a bore in the cutter housing 120. Essentially, the drive slide assembly undergoes a reciprocating up-and-down motion including a downward drive stroke and an upward retraction stroke during each cycle of operation of the machine 30. Considering first the feeding of the staple wire 45, when the stitching head 50 is in its retracted condition, illustrated in FIG. 3, the wire gripping assembly 75 securely grips the supply portion 46 of the stitching wire 45. As the drive slide assembly starts to move down at the beginning of the cycle, the wire gripping assembly 75 draws the wire 45 downwardly and feeds the distal end thereof through the wireholder 135 and a predetermined distance therebelow.

The length of the feed stroke is such that the severed length of stitching wire 45 extends substantially equidistantly above and below the wire holder 135. As the drive slide assembly approaches the end of its downward stroke the pin in its front engages the slot in the operating cam 140 for rotation thereof which, through the action of the spring arm 146, rotates the wire holder 135 in a counterclockwise direction, as viewed in FIG. 3. This rotation of the wire holder 135 results in its cammed movement outwardly of the sleeve 132. During this rotation of the wire holder 135 the lower end of the wire 45 is held in a vertical position and rides across beveled faces of the wire holder 135 as it is retracted in the sleeve 132, all as described in greater detail in the aforementioned '011 patent.

When the wire holder 135 is rotated about 90° counterclockwise, as viewed in FIG. 3, the vertical wire 45 snaps into a groove in the inner end of the wire holder 145 where it is held by an associated spring clip (not shown). Toward the end of the downward stroke the movable cutter 123 is moved by downward movement of the associated cutter operating slide for cooperation with the fixed cutter 122 to sever the wire 45.

When the mechanism reaches the end of its downward stroke, after the lower end of the wire 45 has been severed, the wire gripping assembly 75 is released from the wire 45 and the drive slide assembly then begins to retract upwardly. This upward movement causes a counterclockwise rotation of the operating cam 140, as viewed in FIG. 3, resulting in a clockwise rotation of the wire holder 135 back to its original position. But in this case the securely held severed portion of the wire 45 rotates with the wire holder 135, so that when it has returned to its original position the severed length of wire 45 is disposed horizontally. When the drive slide assembly reaches the end of its upward retraction stroke, the wire gripping assembly 75 operates in a manner described in greater detail in the aforementioned '011 patent to regrip the wire 45. As the wire holder 135 rotates to its original position, it also moves back in axially of the sleeve 132 under the urging of the spring arm 146, thereby to move the severed length of wire 45 into a position directly beneath the bender bar 71.

Figure 5:
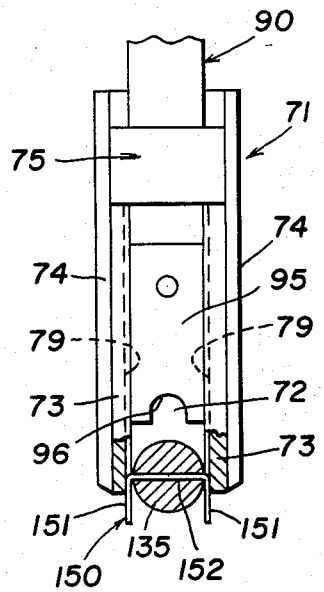
FIG. 5 is a fragmentary, front elevational view of the staple forming portion of the stitching head, taken generally along the line 5—5 in FIG. 4, with portions of the structure broken away.

During the next downward stroke of the drive slide assembly, the drive bar 90 is driven downwardly and it in turn drives downwardly the bender bar 71 through the operation of a resilient coupling mechanism described in the aforementioned '011 patent. As the lower end of the bender bar 71 passes the inner end of the wire holder 135, it engages the severed length of wire 45 and bends the ends of the wire downwardly over the wire holder 135, as illustrated in FIGS. 4 and 5 to form the generally inverted U-shaped staple 150 having straight, parallel, depending leg portions 151 interconnected by a straight bight portion 152. The leg portions 151 of the staple 150 are received respectively in the wire grooves 79 in the bender bar 71. Thus, the bender bar 71 picks up the partially formed staple 150 and carries it beneath the wire holder 135 (see FIG. 6) which, in the meantime, has received the leading end of the next wire section and is being retracted axially outwardly of the sleeve 132, in the manner described above. Meanwhile, the support lever 80 has pivoted forwardly from its retracted position, illustrated in FIG. 4, to its supporting position, illustrated in FIGS. 6 and 7, wherein its foot 82 is disposed between the leg portions 151 of the staple 150 for preventing inward deflection thereof.

Figure 8:
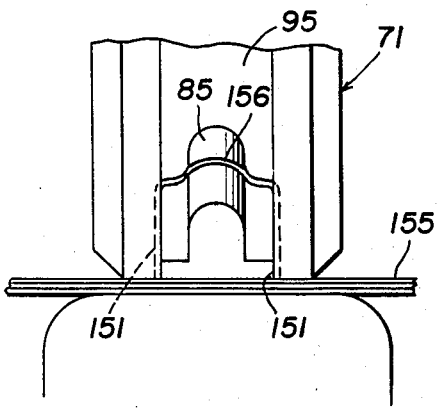
FIG. 8 is a view, similar to FIG. 7, illustrating the parts at the beginning of the formation of the "loop" portion of the staple.

Referring now also to FIGS. 8 through 12 of the drawings, it is a significant aspect of the present invention that the staple 150 is further formed into a "loop"-type staple before driving through an associated workpiece 155. After the bender bar 71 has been driven down to the point where the lower end engages the workpiece 155 (see FIG. 8) its further movement is resisted thereby, and the continued downward movement of the drive slide assembly moves the drive bar 90 downwardly within the bender bar 71. It will be noted that at the point when the lower end of the bender bar 71 touches the workpiece 155, the bight portion 152 of the staple 150 will just engage the top of the projection 85 on the support lever 80. As the drive bar 90 moves down with respect to the bender bar 71, the lower end of the drive member 95 engages the bight portion 152 of the staple 150, receiving the opposite ends thereof respectively in the ends of the groove 97. As the downward movement of the drive member 95 continues, it deforms the bight portion 152 of the staple 150 over the projection 85 of the support lever 80 into an arcuate loop portion 156, as illustrated in FIGS. 8 though 10. As this deformation continues, the projection 85 is received in the recesses 92 and 96 in the lower ends of the drive bar 90 and the drive member 95 until these parts bottom out on the projection 85 (see FIG. 10). At this point, the loop portion of the staple 156 has been completely formed and is received in the groove 97 of the drive member 95.

As the downward movement of the drive member 95 continues, it cams the support lever 80 rearwardly out of the way against the resilient urging of the lever 67 and, at the same time, drives the now completely formed staple 150 downwardly out of the bender bar 71, driving the leg portions 151 through the associated workpiece 155. At the same time, the clincher jaws 42 are carried upward to bend the leg portions 151 over and clinch them in place on the underside of the associated workpiece 155, all in a well known manner, the parts finally arriving at the position illustrated in FIGS. 11 and 12, wherein the staple 150 has been driven through and clinched against the workpiece 155 at the end of the downward driving stroke of the machine 30.

After the stapling operation described above, the drive slide assembly retracts upwardly, pulling with it the drive bar 90 and the bender bar 71 to begin a new cycle. It will be appreciated from the foregoing, that during the downward drive stroke of each cycle of operation of the machine 30, the machine 30 operates to form the length of wire severed during the preceding cycle into a staple and drive it through the associated workpiece 155 and, at the same time, to feed a new length of wire. Thus, in each cycle the machine 30 operates to form and drive a staple from a length of wire which was fed and severed during the preceding cycle.

Figure 13:
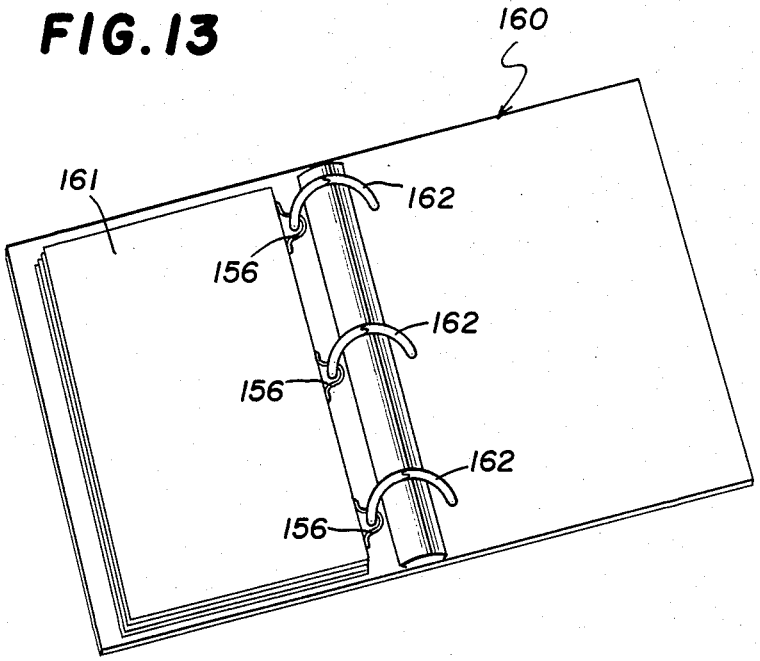
FIG. 13 is a perspective view illustrating an application of the loop staple formed by the present invention for fastening pages to be bound in a ring-type loose leaf binder.
Figure 14:
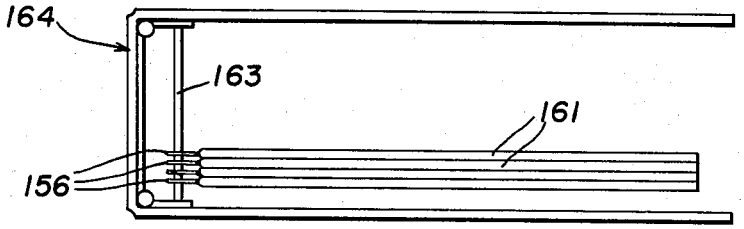
FIG. 14 is a perspective view illustrating use of staples made with the present invention for mounting loose leaf pages in a post binder.
Figure 15:
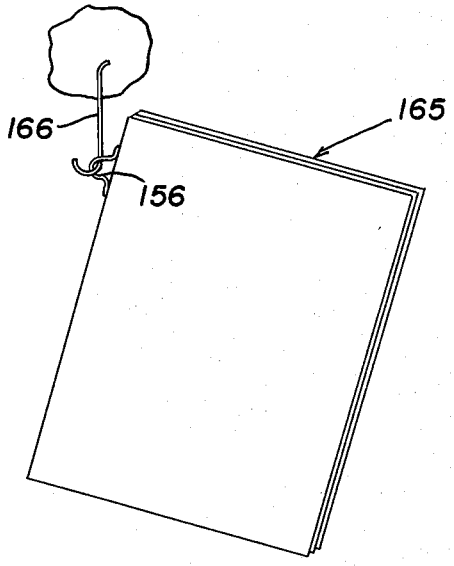
FIG. 15 is a perspective view illustrating application of loop-type staples for hanging fastened pages.
Figure 16:
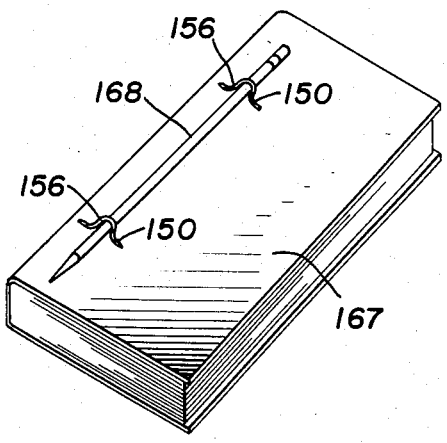
FIG. 16 is a perspective view illustrating another application for loop-type staples made with the present invention.

It will be noted that the loop portion 156 of the staple 150 is spaced from the associated workpiece 155. Referring to FIG. 13. This feature is particularly useful, for example, for mounting the stapled workpiece 155 in an associated loose leaf binder 160. For such an application, the staples 150 may be applied along the fold line of a number of sheets or pages 161 and the loop portions 156 may then respectively be inserted on the rings 162 of the loose leaf binder 160 in a known manner. FIG. 14 illustrates the use of loop-type staples 150 for mounting loose leaf sheets or pages 161 on the posts 163 of a post-type binder 164. The staples 150 may also be used to secure pages along a fold line to form a leaflet or booklet 165, the loop portion 156 of a staple 150 then being looped over an associated hook 166 for hanging the leaflet 165, as illustrated in FIG. 15. Alternatively, staples 150 may be driven into a workpiece such as the cover of a pad of paper 167 or the like, the loop portions 156 being aligned to receive a pencil 168, as illustrated in FIG. 16. These are merely illustrative of the many types of applications for the staples 150.

From the foregoing account it can be seen that there has been provided an improved wire stitching machine which is adapted to form and drive "loop"-type staples, utilizing a standard machine designed for driving and forming standard staples, with only slight modifications to the stitching head. More specifically, the wire stitching head 50 is substantially the same as that disclosed in the aforementioned '011 patent, with the exception of the bender bar 71, the support lever 80, drive bar 90 and the drive member 95. Thus, the stitching head 50 can be utilized in a standard wire stitching machine 30, without any modification to any other part of the machine, for forming "loop"-type staples. Accordingly, by the use of the present invention, a standard wire stitching machine 30 can be operated for forming either standard or "loop"-staples by a simple substitution of stitching heads.

I claim:

1. A wire loop stitching machine for forming into a staple a length of staple wire held in a forming region and driving the formed staple into an associated workpiece, said stitching machine comprising first forming means engageable with said length of staple wire for forming it into a generally inverted U-shaped staple having a pair of substantially straight parallel leg portions interconnected by a substantially straight bight portion disposed substantially perpendicular to said leg portions, and second forming means cooperating with said first forming means independently of the associated workpiece for engagement with said bight portion of said staple subsequent to the formation thereof to deform said bight portion into a curved loop portion which is concave as viewed from the distal ends of said leg portions.

2. The loop stitching machine set forth in claim 1, wherein said first forming means includes a wire holder for holding the length of staple wire in the forming region, and a bending member movable past said wire holder and engageable with the ends of said length of wire for bending said wire over said wire holder.

3. The loop stitching machine of claim 2, wherein said second forming means includes a staple supporting member disposable between said leg portions of said staple and having a forming projection thereon, and a driving member engageable with the bight portion of said staple for deforming it over said projection.

4. The loop stitching machine of claim 1, wherein said second forming means includes a staple supporting member disposable between said leg portions of said staple and having a forming projection thereon, and a driving member engageable with the bight portion of said staple for deforming it over said projection.

5. The loop stitching machine of claim 1, wherein said loop portion of said staple is arcuate in shape.

6. In a wire stitching machine for forming a length of staple wire into a staple and driving the staple along a path into an associated workpiece, including a wire holder and staple forming means for forming the length of staple wire into a generally inverted U-shaped staple having a pair of substantially straight parallel legs interconnected by a substantially straight bight portion, the improvement comprising: staple supporting means movable between a retracted position out of the path of said staple and a supporting position disposed in said path between the leg portions of said staple, said supporting means having a projection disposed toward said bight portion of said staple when said supporting means is disposed in the supporting position thereof, staple driving means movable along said path and having a recess therein for accommodating said projection, said driving means cooperating with said supporting means in the supporting position thereof independently of the associated workpiece for deforming said bight portion of said staple between said projection and said staple driving means into a curved loop portion, said supporting means being responsive to further movement of said staple driving means for returning to its retracted position to accommodate driving of said formed loop staple along said path, and control means for controlling the operation of said supporting means and said staple-driving means to effect formation of said loop portion subsequent to formation of said bight portion.

7. The wire stitching machine of claim 6, wherein said staple forming means has a recess therein for accommodating said projection of said staple supporting means when it is disposed in the supporting position thereof.

8. The wire stitching machine of claim 6, wherein said staple driving means includes a drive bar and a drive member carried on said drive bar, said drive bar and said drive member having recesses therein for accommodating said projection of said staple supporting means in the supporting position thereof.

9. The wire stitching machine of claim 6, and further including drive means for cyclically operating said stitching machine, said drive means being operative in each cycle for feeding and severing a length of staple wire from a continuous supply thereof, forming the length of staple wire into a generally inverted U-shaped staple, and forming a loop in the bight portion of said staple.

* * * * *